US009002242B2

(12) United States Patent
Ishida

(10) Patent No.: US 9,002,242 B2
(45) Date of Patent: Apr. 7, 2015

(54) DEVELOPING APPARATUS

(71) Applicant: Canon Kabushiki Kaisha, Tokyo (JP)

(72) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/776,883

(22) Filed: Feb. 26, 2013

(65) Prior Publication Data

US 2013/0243495 A1 Sep. 19, 2013

(30) Foreign Application Priority Data

Mar. 15, 2012 (JP) ..... 2012-058903

(51) Int. Cl.
*G03G 15/08* (2006.01)

(52) U.S. Cl.
CPC ..... *G03G 15/0812* (2013.01); *G03G 15/0818* (2013.01)

(58) Field of Classification Search
CPC ..... G03G 15/0928; G03G 15/0921; G03G 15/095
USPC ..... 399/119, 120, 258–260, 264, 265, 267, 399/274
See application file for complete search history.

(56) References Cited

U.S. PATENT DOCUMENTS

| | | | | |
|---|---|---|---|---|
| 8,027,624 | B2 | 9/2011 | Yamada et al. | |
| 2008/0131174 | A1* | 6/2008 | Inoue et al. | 399/284 |
| 2011/0069999 | A1* | 3/2011 | Oba et al. | 399/270 |

FOREIGN PATENT DOCUMENTS

| | | | |
|---|---|---|---|
| CN | 101452245 | A | 6/2009 |
| JP | 5-40399 | A | 2/1993 |
| JP | 11-161007 | A | 6/1999 |

(Continued)

OTHER PUBLICATIONS

Chinese Office Action dated Dec. 23, 2014, in related Chinese Patent Application No. 201310076896.7 (with English translation).

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

A developing apparatus includes a grooved developer carrying member configured to carry a developer to a developing region opposing an image bearing member, and a regulating member configured to regulate an amount of the carried developer. The regulating member includes a guide portion configured to guide the developer to a regulating position in which the regulating member is closest to the developer carrying member, with the guide portion being located on an upstream side with respect to the regulating position in a rotation direction of the developer carrying member and being shaped so that a gap between the guide portion and a tangent of the developer carrying member at the regulating position becomes narrower toward a downstream side in the rotation direction. A downstream slope surface is provided on the downstream side in the rotation direction within a region of each of a plurality of grooves, the downstream slope surface being sloped with respect to a normal direction of the developer carrying member. When a downstream end of the downstream slope surface and a downstream end of the guide portion of the regulating member are located in a closest position, the downstream slope surface and the guide portion of the regulating member form an angle θ less than 90°.

4 Claims, 10 Drawing Sheets

(56) References Cited

FOREIGN PATENT DOCUMENTS

| | | | |
|---|---|---|---|
| JP | 2003-140460 | A | 5/2003 |
| JP | 2007-290301 | A | 11/2007 |
| JP | 2008-139585 | A | 6/2008 |

* cited by examiner

DEVELOPING APPARATUS

BACKGROUND OF THE INVENTION

1. Field of the Invention

The present invention relates to a developing apparatus to be used in an image forming apparatus such as a copier and a laser beam printer, which utilizes an electrostatic recording process or an electrophotographic printing process in which an electrostatic image formed on an image bearing member is developed with developer including toner and carrier.

2. Description of the Related Art

Conventionally, an image forming apparatus using an electrophotographic printing process develops, with use of a developing apparatus, an electrostatic latent image formed on a photosensitive member as an image bearing member into a visible toner image with toner included in developer.

The most typical developing apparatus includes a developing container configured to contain developer, a conveyance member configured to covey the developer in the developing container while agitating and mixing the developer, a developer carrying member configured to carry and convey the developer up to a portion opposite to a photosensitive member, and a layer thickness regulating member configured to regulate an amount of the developer on the developer carrying member.

In this context, a developing apparatus which uses a two-component developer including a non-magnetic toner and a magnetic carrier will be described. The developer contained in the developing container is agitated and mixed by a developing screw serving as a conveying member in the developing container. The developer is electrically charged by the triboelectrical charging during the agitation and mixing. The developer thus electrically charged is carried by a developing sleeve as a developer carrying member, which includes therein a magnet having a plurality of magnetic poles and serving as a magnetic-field generating unit, with the aid of a magnetic force of the magnet mainly. This developing sleeve is rotatably arranged at a position opposing the photosensitive member. By rotation of the developing sleeve, the developer is conveyed to a developing region as the opposing portion with respect to the photosensitive member, and subjected to development. In the developing region, a developing bias applied to the developing sleeve causes the toner included in the developer to be transferred onto the electrostatic latent image formed on a surface of the photosensitive member, and a toner image corresponding to the electrostatic latent image is formed on the surface of the photosensitive member. In general, in many of such developing apparatus, a regulating blade as the layer thickness regulating member is arranged to oppose an outer peripheral surface of the developing sleeve with a predetermined gap between them. There have been proposed various regulating blades, such as a magnetic plate regulating blade, a non-magnetic plate regulating blade, a combination thereof, and an elastic regulating blade, and such regulating blades have been practically used. When the developer is conveyed to the developing region, the amount of the developer carried by the developing sleeve is regulated at a time of passing through the gap between the developing sleeve and the regulating blade. In this way, the developer is controlled to be supplied by a stable amount. Normally, one of the magnetic poles of the magnet (referred to as a cutting pole) is opposed to an opposing portion of the regulating blade so that the developer amount is regulated while a developer pool is formed. In such a configuration, a certain amount of the developer can be constantly secured in an immediately upstream portion with respect to the regulating blade, and hence the developer can be stably supplied to the developing sleeve.

As a developing sleeve configured to efficiently convey the two-component developer, there has been conventionally known a developer carrying member having a surface roughened by a sand-blasting process. The roughened surface of this developing sleeve has higher frictional resistance, and hence more developer can be drawn-up and conveyed. However, along with abrasion due to rubbing against the developer, the surface is gradually smoothened, which causes reduction in developer conveying amount with the passage of time. Further, magnetic carrier particles contained in the developer are rubbed against fine projections and recesses on the surface, and hence the magnetic carrier particles themselves are also abraded. As a result, the reduction in developer conveying amount becomes more serious with the passage of time. In addition, graininess appears in the visible image after development, and uneven image density in halftone portions thereof becomes conspicuous. For those reasons, it is significantly difficult to maintain high image quality over a long period.

In view of the circumstances, as a developer carrying member configured to suppress the graininess and the uneven image density, there has been known a developer carrying member having a surface provided with a plurality of V-grooves. With the developer carrying member of this type, developer particles can be captured by the plurality of grooves formed in the surface, and efficiently conveyed. In addition, even after the surface is abraded, the frictional resistance does not significantly vary, and the abrasion of the magnetic carrier particles is reduced. Thus, deterioration in image quality with the passage of time can be effectively suppressed.

However, when the above-mentioned conventional developing sleeve provided with the V-grooves was used over a long period, the developer was compressed and subjected to shear by the back of the regulating blade. As a result, toner particles clog the recessed portions of the V-grooves, which may cause deterioration in developer conveying property and occurrence of an uneven pitch image due to a groove period. Specifically, the developer compressed on the backside of the regulating blade is conveyed partially in a flow toward the surface of the developing sleeve while being guided by a surface of the regulating blade, and hence the toner particles clog the V-grooves. In particular, as for the two-component developer including a toner and a magnetic carrier, particles of the developer are attracted to the surface of the developing sleeve by the magnet surrounded by the developing sleeve, to thereby hold the developer. In this state, as described above, the developer is compressed particularly on the backside of the regulating blade, and hence the toner is subjected to shear. As a result, particles of the toner gradually clog the recessed portions of the V-grooves.

SUMMARY OF THE INVENTION

The present invention has been made in view of the above-mentioned problems, and provides a developing apparatus including a developer carrying member having a surface provided with a plurality of grooves, which reduces clogging toner in the plurality of grooves of the developer carrying member caused by developer being guided by a surface of the regulating member configured to regulate the developer.

According to an exemplary embodiment of the present invention, there is provided a developing apparatus, including; a developer carrying member configured to carry a developer to a developing region opposing an image bearing member, the developer carrying member having a surface provided with a plurality of grooves, a regulating member configured to regulate an amount of the developer carried by the developer carrying member, a slope portion provided on the regulating member in an opposing portion in which the regulating member opposes the surface of the developer carrying member, the slope portion being sloped so that a gap between the slope portion and the developer carrying member is narrowed toward a downstream side in a rotation direction of the developer carrying member; and a downstream slope surface provided on the downstream side in the rotation direction of the developer carrying member within a region of each of the plurality of grooves, the downstream slope surface being sloped with respect to a normal direction of the developer carrying member, wherein, when a downstream end of the downstream slope surface and a downstream end of the slope portion of the regulating member are located in a closest position, the downstream slope surface and the slope portion of the regulating member form an angle θ less than 90°.

In the present invention, it is possible to provide the developing apparatus including the developer carrying member having the surface provided with the plurality of grooves, which reduces clogging toner in the plurality of grooves of the developer carrying member caused by the developer being guided by the surface of the regulating member configured to regulate the developer.

Further features of the present invention will become apparent from the following description of exemplary embodiments with reference to the attached drawings.

DESCRIPTION OF THE EMBODIMENTS

In the following, an image forming apparatus according to the present invention will be described in more detail with reference to the drawings.

First Embodiment

Figure 1:
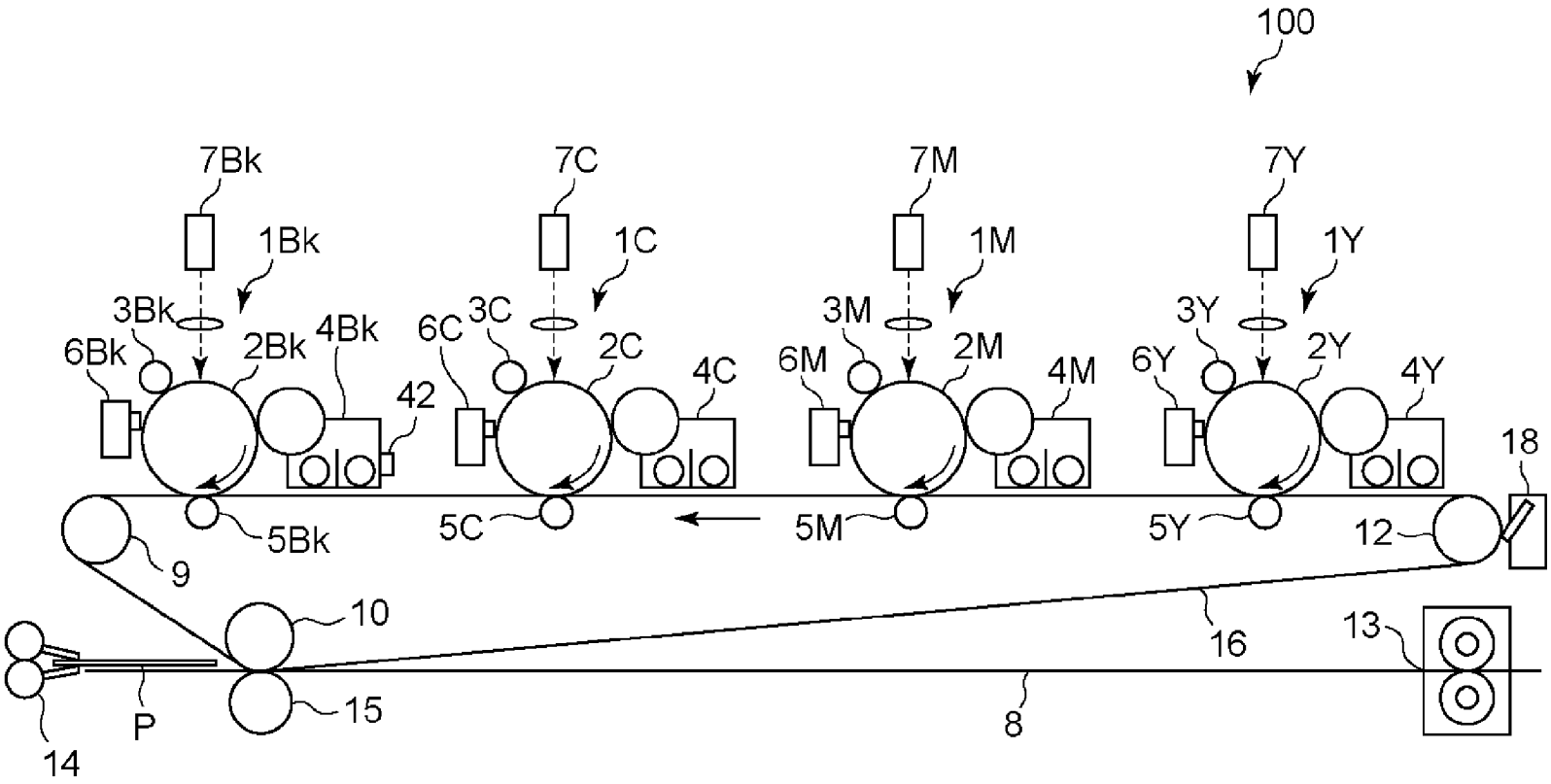
FIG. 1 is a schematic structural view of an example of an image forming apparatus according to which an embodiment of the present invention is applied.

First, an overall structure and an operation of an image forming apparatus according to the embodiment of the present invention will be described. FIG. 1 is a schematic structural view of an image forming apparatus 100 according to the embodiment. The image forming apparatus 100 is an electrophotographic full-color printer including four image forming portions 1Y, 1M, 1C, and 1Bk provided correspondingly to four colors of yellow, magenta, cyan, and black, respectively. The image forming apparatus 100 forms a four-full-color image onto a recording material (such as a recording paper, a plastic film, and a cloth) in response to image signals from an original reading apparatus (not shown) connected to a main body of the image forming apparatus 100.

Further, the image formation can be performed in response not only to the image signals from the original reading apparatus but also to image signals from a host apparatus such as a personal computer connected to the main body of the image forming apparatus 100 so as to perform data communication therewith.

In the image forming portions 1Y, 1M, 1C, and 1Bk, toner images formed on respective electrophotographic photosensitive members 2Y, 2M, 2C, and 2Bk each serving as an image bearing member are transferred onto an intermediate transfer belt 16, and then transferred onto a recording material P conveyed by a recording material conveying member (recording material carrying member) 8. In the following, this structure will be described in detail.

Note that, in the embodiment, the four image forming portions 1Y, 1M, 1C, and 1Bk of the image forming apparatus 100 have substantially the same structure except for different colors of the developers. Thus, in the following, unless it is necessary to make specific distinctions, suffixes Y, M, C, and Bk for indicating the respective image forming portions 1Y, 1M, 1C, and 1Bk are omitted from reference symbols designating the structures. Those structures will be generally designated by the reference symbols without the suffixes.

The image forming portion 1 includes a cylindrical photosensitive member or the photosensitive drum 2 as an image bearing member. The photosensitive drum 2 is driven and rotated in a direction indicated by the arrow in FIG. 1.

The image forming portion 1 includes a charging roller 3 as a charging unit, a developing apparatus 4 as a developing unit, a primary transfer roller 5 as a transfer unit, and a cleaning device 6 as a cleaning unit, which are arranged around the photosensitive drum 2. In addition, the image forming portion 1 further includes a secondary transfer roller 15 and an opposed secondary transfer roller 10, which serve as another transfer unit. A laser scanner (exposure device) 7 as an exposure unit is arranged above the photosensitive drum 2 in FIG. 1. The intermediate transfer belt 16 is arranged opposite to the photosensitive drums 2 of the image forming portions 1. The intermediate transfer belt 16 is driven by a driving roller 9 and rotated in a direction indicated by an arrow in FIG. 1 so that the toner images are conveyed to an abutment portion in which the toner images are brought into contact with the recording material P. Next, after the toner images are transferred from the intermediate transfer belt 16 onto the recording material P, the toner images are heat-fixed to the recording material P by a fixing device 13.

As an example, how to form the four-full-color image will be described. When an image forming operation is started, first, a surface of the rotated photosensitive drum 2 is uniformly charged by the charging roller 3. At this time, a charging bias is applied from a charging bias power source to the charging roller 3. Next, the photosensitive drum 2 is exposed with a laser beam corresponding to an image signal issued from the exposure device 7. With this, an electrostatic image (latent image) corresponding to the image signal is formed on the photosensitive drum 2. The electrostatic image on the photosensitive drum 2 is developed into a visible image with toner contained in the developing apparatus 4. In the embodiment, there is employed a reversal developing process by which toner is caused to adhere to light sections, which are exposed by the laser beam, with the aid of a light section potential.

The developing apparatus 4 forms the toner image onto the photosensitive drum 2, and the toner image is primarily transferred onto the intermediate transfer belt 16. The cleaning device 6 removes toner (untransferred residual toner), which remains on a surface of the photosensitive drum 2 even after the primary transfer.

This series of operations is sequentially performed in the image forming portions 1Y, 1M, 1C, and 1Bk corresponding respectively to yellow, magenta, cyan, and black, and the toner images of those four colors are superimposed on top of one another on the intermediate transfer belt 16. After that, in accordance with a time of formation of the toner images, the recording material P contained in a recording material containing cassette (not shown) is conveyed by a supply roller pair 14 and the conveying member 8. Then, the secondary transfer roller 15, to which a secondary transfer bias is applied, secondarily transfers the four color toner images on the intermediate transfer belt 16 collectively onto the recording material P carried on the conveying member 8.

Next, the recording material P is separated from the conveying member 8, and conveyed into the fixing device 13 as a fixing unit. This fixing device 13 heats and presses the toner images so that the toners on the recording material P are fused and mixed with each other. With this, a full-color permanent image is formed. After that, the recording material P is delivered to an outside of the image forming apparatus.

Meanwhile, an intermediate transfer belt cleaner removes residual toner which is not secondarily transferred at the secondary transfer portion and remains on the intermediate transfer belt 16. Then, the series of operations is completed.

Note that, an image of a single desired color or an image of a plurality of desired colors may be formed by using only the desired one or ones of the image forming portions.

Figure 2:
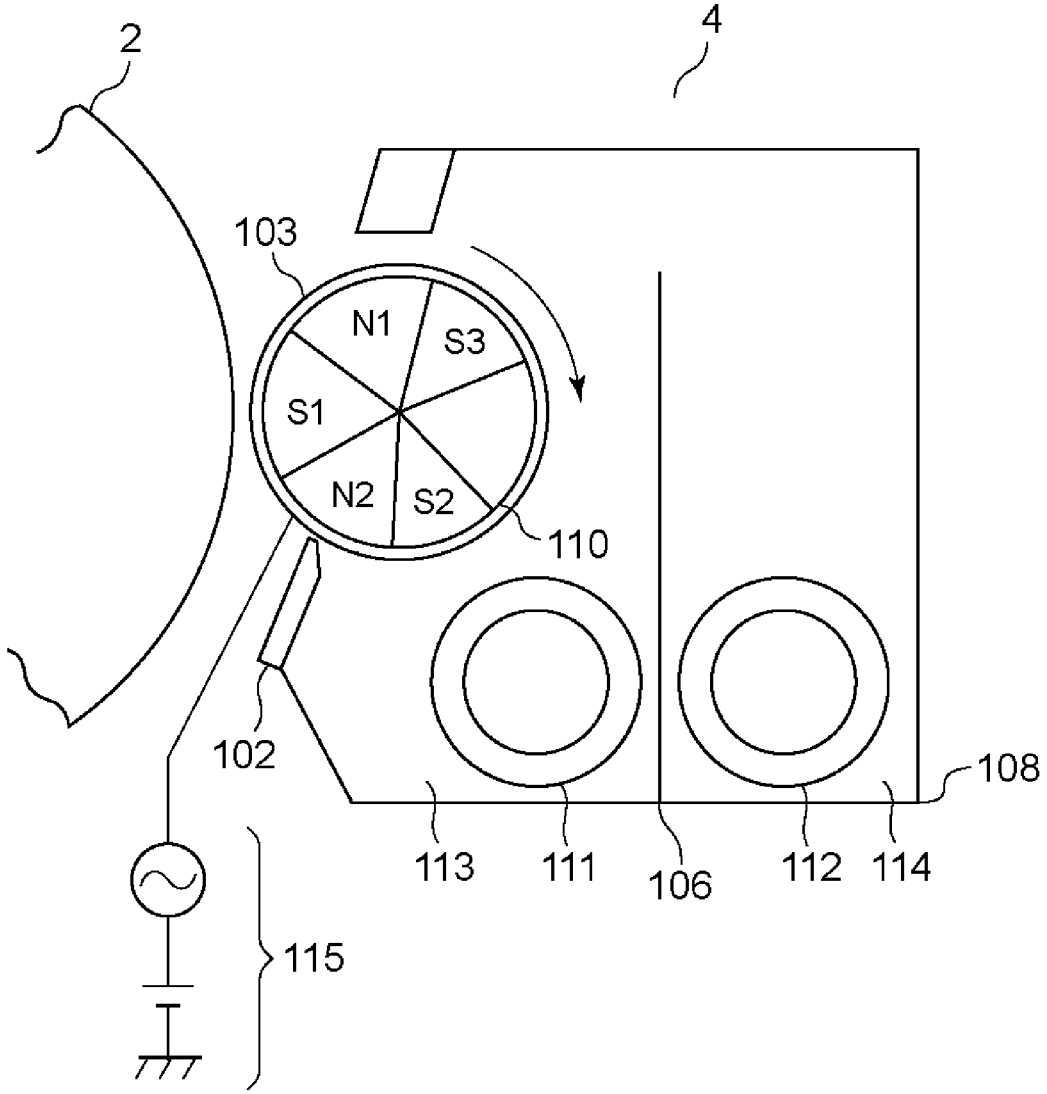
FIG. 2 is an explanatory view of a developing apparatus according to the embodiment of the present invention.

Next, the developing apparatus 4 will be described with reference to FIG. 2. In the embodiment, all the developing apparatus corresponding to yellow, magenta, cyan, and black have perfectly the same structure. FIG. 2 is a plan view in which the developing apparatus 4 is viewed from the front of FIG. 1.

The developing apparatus 4 includes a developing container (developing apparatus main body) 108 containing a two-component developer including non-magnetic toner particles (toner) and magnetic carrier particles (carrier) as main components.

The toner includes color resin particles containing a binder resin, a colorant, and other additives as appropriate, and color particles to which an extraneous additive such as fine powder of colloidal silica is externally added. The toner includes a negatively chargeable polyester resin produced by a polymerization method, and preferably has a volume-average particle diameter of 5 μm or more and 8 μm or less. In the embodiment, the volume-average particle diameter was 6.2 μm.

Preferred examples of materials for the carrier include surface oxidized or unoxidized metal such as iron, nickel, cobalt, manganese, chromium, a rare earth, alloys of those metals, and an oxide ferrite. A manufacturing method for the magnetic carrier particles of those types is not particularly limited. The carrier has a weight-average particle diameter of from 20 μm to 50 μm, preferably from 30 μm to 40 μm, and has a resistivity of $10^7$ Ω·cm or more, preferably $10^8$ Ω·cm or more. In the embodiment, the resistivity was $10^8$ Ω·cm. Further, the carrier used in the embodiment was a low specific gravity magnetic carrier; specifically, a resin magnetic carrier produced by the polymerization method in which a magnetic metal oxide and a non-magnetic metal oxide were mixed with a phenolic binder resin at a predetermined ratio. The carrier used in the embodiment has a volume-average particle diameter of 35 μm, a true density of from 3.6 g/cm$^3$ to 3.7 g/cm$^3$, and a mass magnetization of 53 A·m$^2$/kg.

As illustrated in FIG. 2, the developing apparatus 4 includes the developing container 108, a developing sleeve 103 as a developer conveying unit (developer carrying member), and a regulating blade 102 as a member configured to regulate a magnetic brush height of the developer. A partition wall 106 extending in a vertical direction divides an inside of the developing apparatus 4 into a developing chamber 113 and an agitating chamber 114. An upper portion of the partition wall 106 is opened. In the embodiment, the developing chamber 113 and the agitating chamber 114 contain the two-component developer including the non-magnetic toner and the magnetic carrier. A surplus part of the two-component developer in the developing chamber 113 is collected into the agitating chamber 114.

A first agitating screw 111 and a second agitating screw 112 are disposed in the developing chamber 113 and the agitating chamber 114, respectively. The first agitating screw 111 agitates and conveys the developer in the developing chamber 113. Meanwhile, under control by a developer density control device, the second agitating screw 112 agitates and conveys toner supplied from a toner supply tank (not shown) to an upstream side of the second agitating screw 112 and developer already existing in the agitating chamber 114. In this way, toner density is equalized. The partition wall 106 includes developer paths (not shown) formed at a front side end portion and a back side end portion in a direction perpendicular to the drawing sheet of FIG. 2, which allow the developing chamber 113 and the agitating chamber 114 to communicate to each other. Conveying forces of the agitating screws 111 and 112 described above cause the developer in the developing chamber 113, which is reduced in toner density as a result of toner consumption through development, to be moved into the agitating chamber 114 through one of the developer paths.

The developing chamber 113 of the developing apparatus 4 is provided with an opening portion opened at a position corresponding to a developing region opposing the photosensitive drum 2, and the developing sleeve 103 is rotatably arranged so as to be partially exposed in the opening portion. The developing sleeve 103 is formed of a non-magnetic material such as aluminum and stainless steel, and rotated in the direction indicated by the arrow in FIG. 2 during developing operation. The developing sleeve 103 includes a magnet (magnet roller) 110 fixed therein as a magnetic-field generating unit. The developing sleeve 103 carries a layer of the two-component developer subjected to layer thickness regulation by the regulating blade 102 formed of a non-magnetic material such as aluminum and stainless steel, and develops a latent image by supplying the developer onto the photosensitive drum 2 in the developing region opposing the photosensitive drum 2. In the embodiment, the regulating blade 102 is made of stainless steel. A predetermined gap is secured between the developing sleeve 103 and the regulating blade 102. In the embodiment, the predetermined gap is 300 μm.

Figure 3:
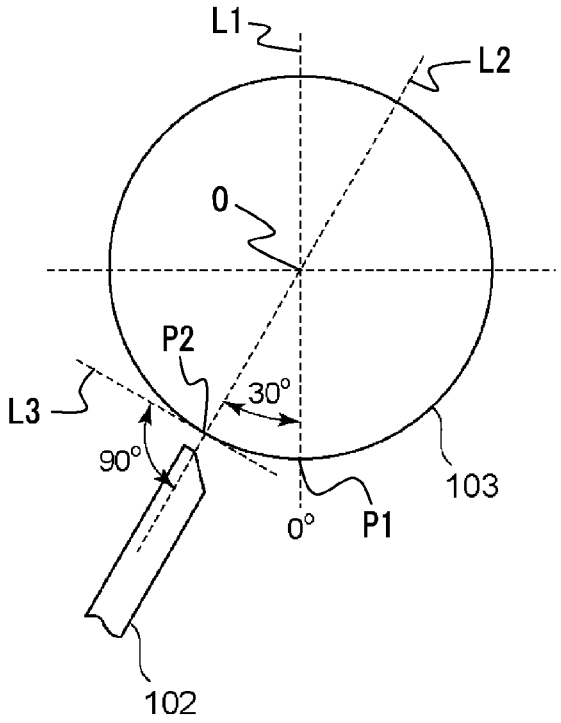
FIG. 3 is an explanatory view of an abutment position of a regulating blade for use in a first embodiment of the present invention.

Further, as illustrated in FIG. 3, in the embodiment, a position (abutment position) of the regulating blade 102 with respect to the developing sleeve 103 is set as follows. An angle formed by a line L1 connecting a gravity direction lowermost point P1 of the developing sleeve 103 and a developing sleeve center O with a line L2 connecting a closest point P2 of the developing sleeve 103 with respect to the regulating blade 102 and the developing sleeve center O is 30°. Further, an angle (abutment angle) of the regulating blade 102 with respect to the developing sleeve 103 is set to 90° with respect to a tangent L3 of the developing sleeve 103 at the closest point P2.

A power source 115 supplies the developing sleeve 103 with a developing bias voltage obtained by superimposing an alternating-current voltage on a direct-current voltage. In the embodiment, a square wave of AC bias having a frequency of 10 kHz and an amplitude of 1,000 V is used.

With the structure described above, the developing apparatus 4 holds developer supplied by the agitating screws 111 and 112 to a surface of the developing sleeve 103 in a form of a magnetic brush with a magnetic force of the magnet roller 110. By rotation of the developing sleeve 103, the developer supplied to the surface of the developing sleeve 103 is conveyed to an opposing portion (developing region) with respect to the photosensitive drum 2. Further, the developer on the developing sleeve 103 is regulated by the regulating blade 102 so that the developer is always supplied to the developing region by an appropriate amount.

In more detail, similarly to a magnetic roller of a conventional developing apparatus, the magnet roller 110 includes five poles. The developer agitated by the first agitating screw 111 in the developing chamber 113 is held by a magnetic force of a conveying magnetic pole (draw-up pole) S2 for drawing up the developer, and then conveyed by rotation of the developing sleeve 103. In order to stably hold the developer, the developer is held sufficiently with another conveying magnetic pole (cutting pole) N2 having a certain magnetic flux density or higher. In this way, the developer can be conveyed in the form of a magnetic brush. Then, the magnetic brush is trimmed by the regulating blade 102 so that the developer amount is adjusted. Next, at a position of a development pole S1, the toner on the developing sleeve 103 is transferred to the electrostatic latent image on the photosensitive drum 2, and the electrostatic latent image is developed into a visible toner image. At this time, the power source 115 provided on the side of the main body of the image forming apparatus 100 supplies the developing sleeve 103 with the developing bias voltage obtained by superimposing an alternating-current voltage on a direct-current voltage. Then, after completion of the development, a collecting magnetic pole N1 and a stripping magnetic pole S3 cause the developer to be collected into the developing container.

Next, with reference to FIG. 4, the regulating blade 102 used in the embodiment will be described in detail.

Figure 4:
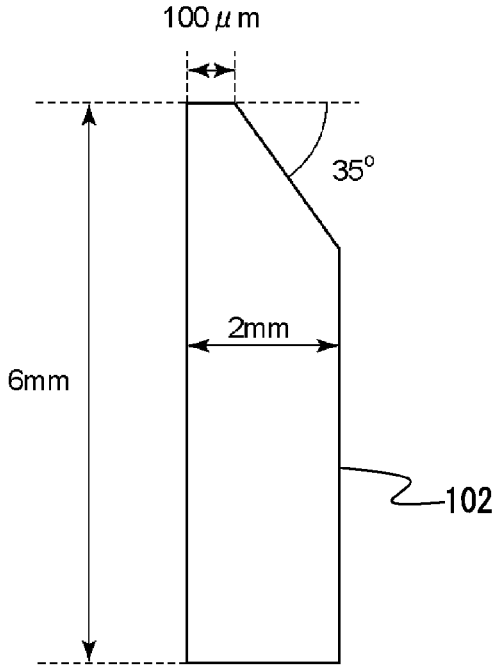
FIG. 4 is an explanatory view of the regulating blade according to the first embodiment of the present invention.

FIG. 4 is a sectional view of the regulating blade 102. In the embodiment, a distal end portion on a developer regulating side (upstream side in a rotation direction of the developing sleeve 103) of the regulating blade 102 is formed to have a slope so that a wedge-like space is formed between the distal end portion and the surface of the developing sleeve 103 (groove free area). As illustrated in FIG. 4, the slope of the distal end portion of the regulating blade 102 used in the embodiment is formed at an angle of 35°, and the distal end portion of the regulating blade 102 includes a straight portion having a length of 100 μm.

Figure 5A:
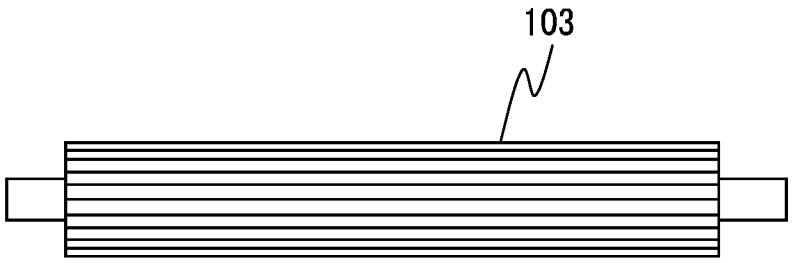
FIGS. 5A and 5B are explanatory views of a developing sleeve according to the first embodiment of the present invention.
Figure 5B:
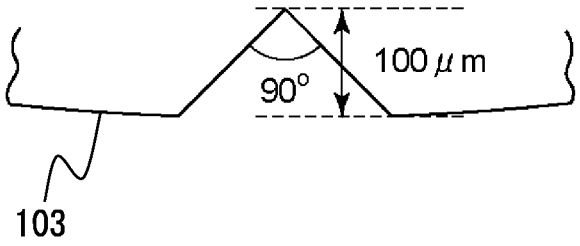

Next, with reference to FIGS. 5A and 5B, the developing sleeve 103 used in the embodiment will be described in detail. As illustrated in FIG. 5A, the surface of the developing sleeve 103 used in the embodiment is provided with V-grooves formed at substantially equal intervals. As illustrated in FIG. 5B, the developing sleeve 103 used in the embodiment has an outer diameter of 20 mm, and includes eighty (80) V-grooves each formed at a depth of 100 μm and an angle of 90°.

Figure 6:
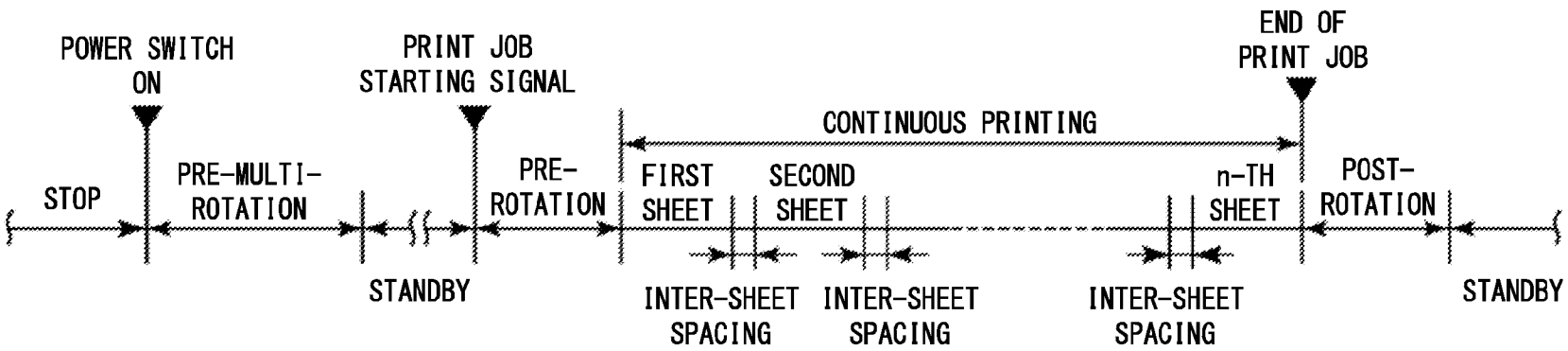
FIG. 6 is a view of illustrating operational steps of the image forming apparatus according to the first embodiment of present invention.

Next, the operation of the above-mentioned image forming apparatus 100 will be described in detail with reference to an operation process chart of FIG. 6.

"a": pre-multi-rotation step

A pre-multi-rotation step corresponds to a start (activation) operation period (warm-up period) of the image forming apparatus 100. A main power switch of the image forming apparatus 100 is turned ON for activating a main motor of the image forming apparatus 100. In this way, preparatory operations of required processing devices are executed.

"b": standby

After completion of the predetermined start operation period, drive of the main motor is stopped, and the image forming apparatus 100 is maintained in a standby (waiting) state until input of a print job starting signal.

"c": pre-rotation step

A pre-rotation step corresponds to a period in which the main motor is re-driven in response to the input of the print job starting signal so that print job pre-operations of the required processing devices are executed.

More practically, the following steps are executed in the order named: (1) the image forming apparatus 100 receives the print job starting signal; (2) a formatter develops an image (development time period varies depending on a data amount of the image and a processing speed of the formatter); and (3) the pre-rotation step is started.

Note that, in a case where the print job starting signal has already been input during the pre-multi-rotation step of the above-mentioned item "a", after completion of the pre-multi-rotation step, the flow skips the standby of the above-mentioned item "b" and subsequently proceeds to the pre-rotation step of the above-mentioned item "c".

"d": print job execution

After the predetermined pre-rotation step is completed, the image formation process described above is subsequently executed, and a recording material subjected to the image formation is output.

In a case of a continuous print job, the image formation process described above is repeated, and a predetermined number of recording materials subjected to the image formation are sequentially output.

"e": inter-sheet spacing step

An inter-sheet spacing step refers to a step of an interval between a trailing edge of one recording material P and a leading edge of a subsequent recording material P in the case of the continuous print job, which corresponds to a period of a non-sheet passing state in a transfer portion and a fixing device.

"f": post-rotation step

A post-rotation step corresponds to a period in which operations after the print job of the required processing devices are executed by keeping the main motor to be driven for a predetermined period after a single recording material subjected to the image formation is output in a case of a single sheet print job or after the last one of the recording materials subjected to the image formation in a continuous print job is output in a case of the continuous print job.

"g": standby

After completion of the predetermined post-rotation step, the drive of the main motor is stopped, and the image forming apparatus 100 is maintained in the standby (waiting) state until input of a subsequent print job starting signal.

In the above description, the period of the print job execution of the item "d" corresponds to a time of an image formation, and the period of the pre-multi-rotation step of the item "a", the period of the pre-rotation step of the item "c", the period of the inter-sheet spacing step of the item "e", and the period of the post-rotation step of the item "f" correspond to a time of a non-image formation.

The time of non-image formation corresponds to the time of at least one step of the above-mentioned pre-multi-rotation step, pre-rotation step, inter-sheet spacing step, and post-rotation step, and to at least a predetermined period in the time of the at least one step.

At the time of non-image formation described above, while at least the photosensitive drum 2 and the developing sleeve 103 continue to be rotated, predetermined voltages are applied to the charging roller 3 and the developing sleeve 103. With this, a predetermined potential difference (fog removal potential) is generated between the photosensitive drum 2 and the developing sleeve 103 so that occurrence of toner fogging and carrier adhesion owing to the rotations of the photosensitive drum 2 and the developing sleeve 103 at the time of the non-image formation is suppressed. The fog removal potential is set equivalently to that in normal image formation. Specifically, in the embodiment, a surface potential (Vd potential) of the photosensitive drum 2 is set to −500 V, a developing bias voltage (Vdc) is set to −300 V, and the fog removal potential is set to 200 V.

Figure 7A:
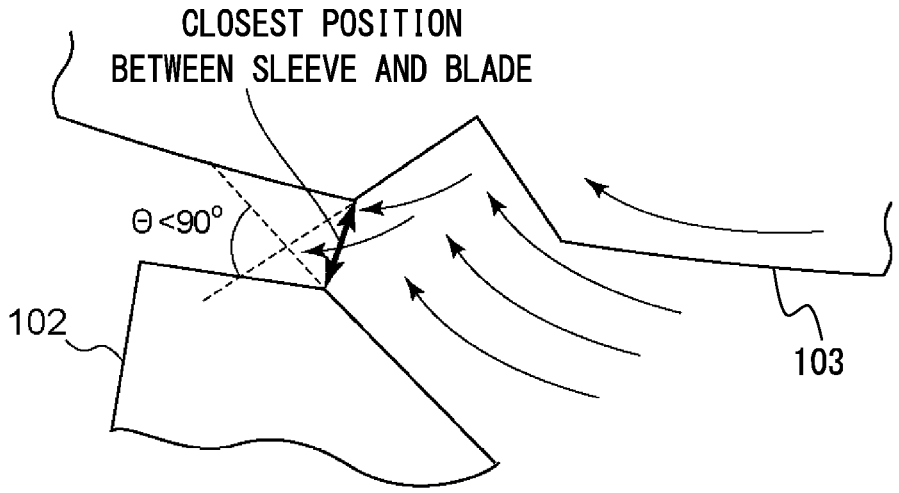
FIGS. 7A, 7B, and 7C are explanatory views illustrating movement of developer particles according to the first embodiment of the present invention.
Figure 7B:
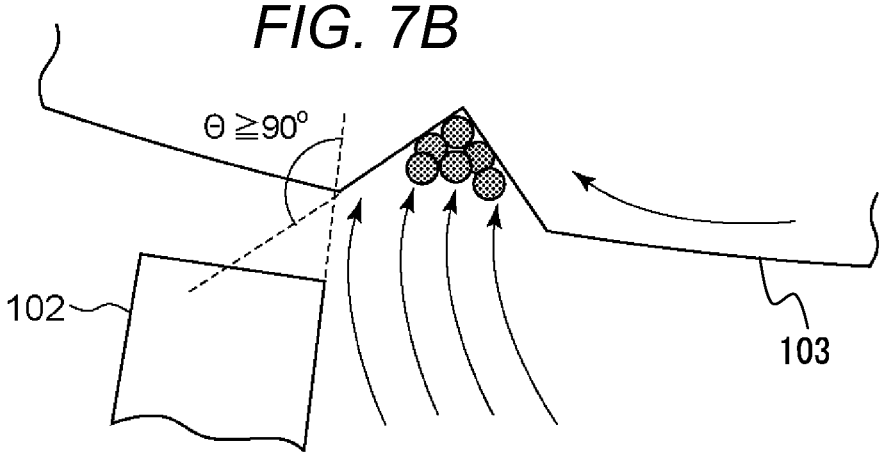
Figure 7C:
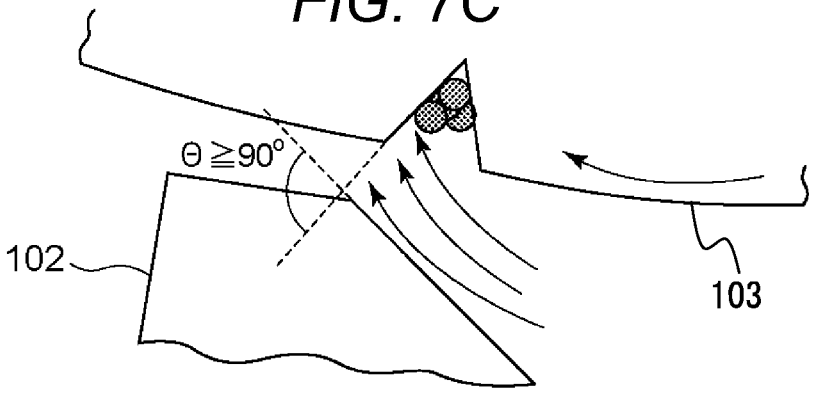

Next, with reference to FIGS. 7A, 7B, and 7C, movement of particles of the developer at an upstream position with respect to the regulating blade 102 will be described. FIGS. 7A, 7B, and 7C are schematic sectional views each schematically illustrating a state of the two-component developer on the upstream side with respect to the position of the regulating blade 102. The developer drawn up to the surface of the developing sleeve 103 is carried on the surface of the developing sleeve 103, and conveyed up to a vicinity of a position of the regulating blade 102 on the upstream side in a developer conveying direction. The developer conveyed to the vicinity on the upstream side with respect to the regulating blade 102 is subjected to the layer thickness regulation at a position of a gap between an edge of the regulating blade 102 and the surface of the developing sleeve 103, and partially conveyed to the developing region through the gap. As illustrated in FIG. 7A, the distal end portion on the developer regulating side (upstream side in the rotation direction of the developing sleeve 103) of the regulating blade 102 is formed to have the slope.

In other words, the regulating blade 102 includes a slope portion which narrows the gap between the regulating blade 102 and the developing sleeve 103 toward the downstream side in the rotation direction of the developing sleeve 103.

Meanwhile, the surface of the developing sleeve 103 is provided with the plurality of grooves. The plurality of grooves each have a sectional shape in which slope surfaces sloped with respect to a normal direction of the developing sleeve 103 are formed respectively on the upstream side and the downstream side in the rotation direction of the developing sleeve 103.

A downstream end portion of the groove formed in the surface of the developing sleeve 103 passes a downstream end portion of a slope surface of the regulating blade 102 (the downstream end portion of the groove and the downstream end portion of the slope surface of the regulating blade 102 come closest to each other). At this time, an angle θ less than 90° is formed by the slope surface of the regulating blade 102 with the slope surface of the V-groove on the downstream side in the rotation direction of the developing sleeve 103. With this, a flow of the developer toward a bottom surface of a groove recessed portion is suppressed, and the developer smoothly flows out from the groove bottom surface. As a result, clogging toner in the groove portion is reduced. Meanwhile, as illustrated in FIG. 7B, when a conventional flat-plate-shaped regulating blade is employed instead of the regulating blade 102 in FIG. 7A, the angle θ formed by the slope surface of the regulating blade with the downstream surface of the V-groove in the rotation direction of the developing sleeve 103 reaches 90° or more. Thus, the flow of the developer toward the bottom surface of the groove recessed portion causes a shearing action, with the result that groove-clogging toner occurs. Alternatively, as illustrated in FIG. 7C, when an angle of the groove is set to be lower than that in FIG. 7A (for example, set to 60°), the angle θ formed by the slope surface of the regulating blade with the downstream surface of the V-groove in the rotation direction of the developing sleeve 103 reaches 90° or more as in the configuration illustrated in FIG. 7B. As a result, the slope surface of the V-groove on the downstream side in the rotation direction of the developing sleeve 103 (downstream slope surface) causes a flow of the developer conveyed along the slope portion of the regulating blade toward the bottom surface of the groove recessed portion. As a result, also in this case, this flow of the developer described above causes the shearing action, and the groove-clogging toner occurs.

Note that, although the angle of the groove is set to 90° in the embodiment, it is desired that the angle of the groove be set to 120° or less in view of a developer conveying force. This is because, when the angle of the groove was set to more than 120°, the developer conveying force became lower, and required appropriate developer conveying properties were not secured in some cases.

Figure 8A:
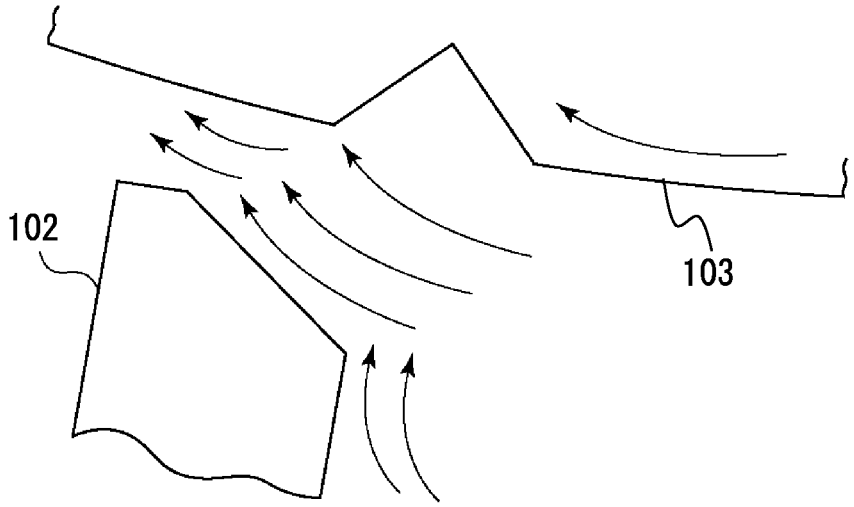
FIGS. 8A and 8B are explanatory views illustrating the movement of the developer particles according to the first embodiment of the present invention.
Figure 8B:
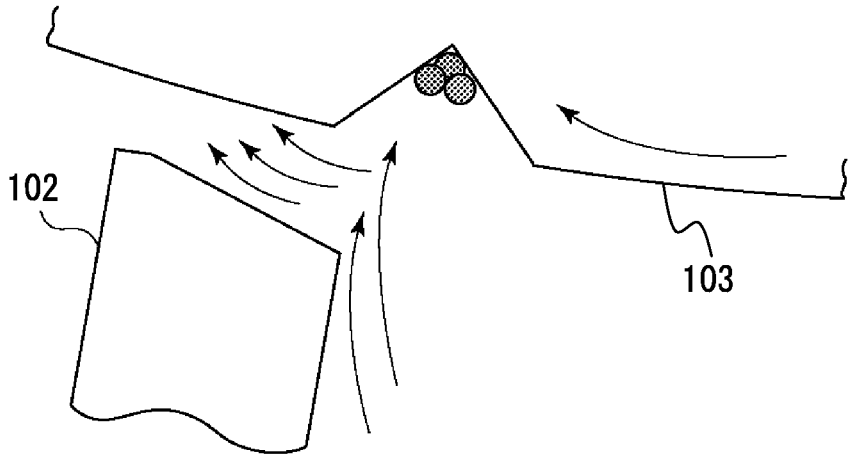

Further, although a slope angle of the regulating blade 102 is set to 35° in the embodiment, it is desired that the slope angle be set to 30° or more in view of smoothness of a flow of the developer on the back of the regulating blade 102. As compared to the flow of the developer in the configuration in the embodiment, which is illustrated in FIG. 8A, when the slope angle is set to less than 30° as illustrated in FIG. 8B, the flow of the developer on the back of the regulating blade 102 is liable to be directed to the developing sleeve 103. In this way, a slight groove-clogging toner infrequently occurs even when the angle θ is set to less than 90°.

Further, in view of respective appropriate ranges of the angle of the groove and the slope angle of the regulating blade 102 described above; specifically, when the angle of the groove is set to 120° or less and the slope angle of the regulating blade 102 is set to 30° or more, it is conceived that a desired lower limit of the angle θ is approximately 60°.

Figure 9A:
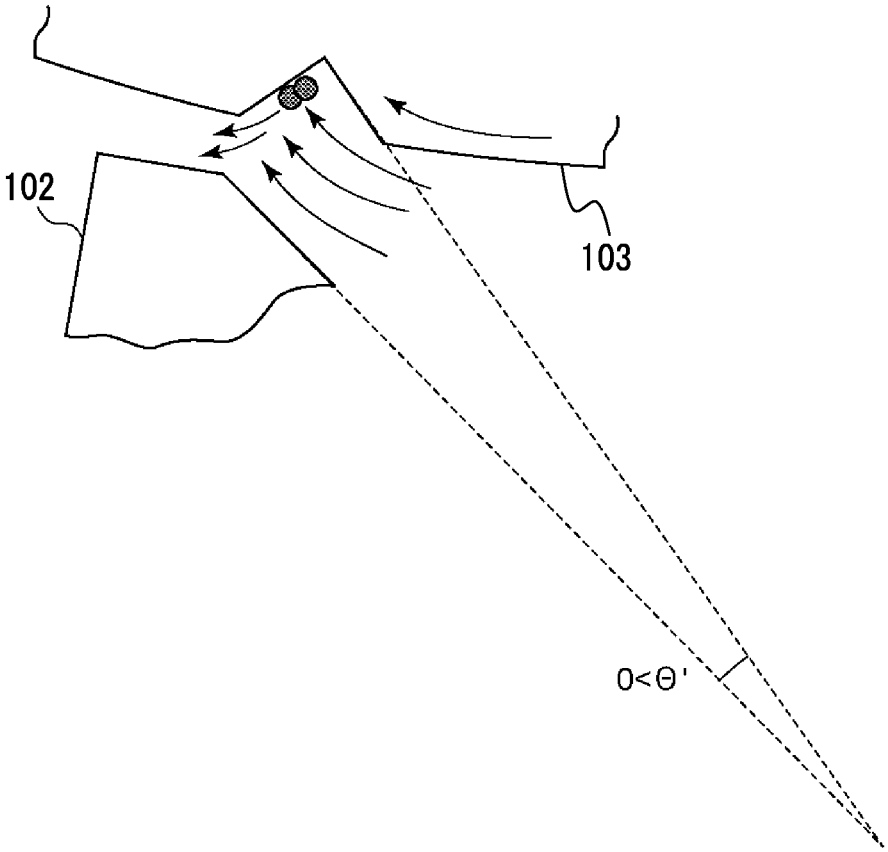
FIGS. 9A and 9B are explanatory views illustrating the movement of the developer particles according to the first embodiment of the present invention.
Figure 9B:
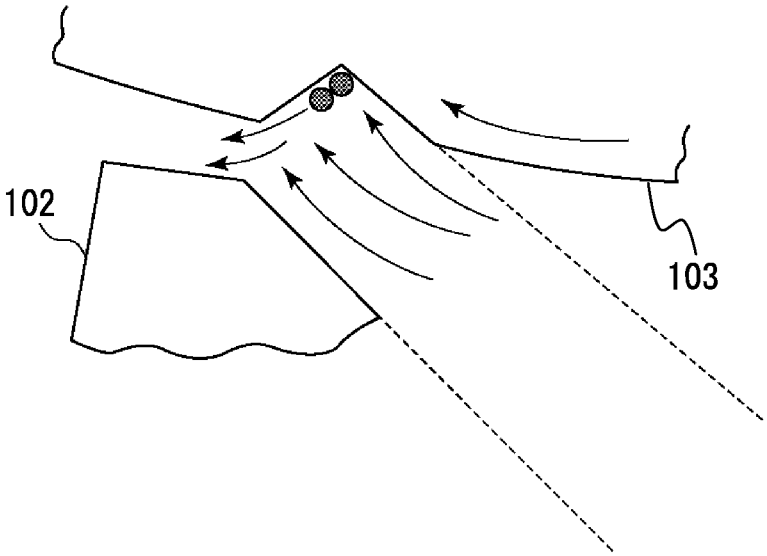

Further, in the embodiment, in the case where the V-groove portions of the surface of the developing sleeve 103 is located in the closest position between the developing sleeve 103 and the regulating blade 102, the angle θ formed by the slope surface of the regulating blade 102 with the downstream surface of the V-groove in the rotation direction of the developing sleeve 103 is set to less than 90°. In addition, as illustrated in FIG. 9A, an angle θ' formed by the slope surface of the regulating blade 102 with an upstream surface of the V-groove in the rotation direction of the developing sleeve 103 (upstream slope surface) is set as follows. Specifically, the angle θ' is defined as an angle formed by an extended line of the slope surface of the regulating blade 102 with an extended line of the upstream surface of the V-groove in the rotation direction of the developing sleeve 103, which extended lines are extended toward the inside of the developing container (outwardly from the developing sleeve 103), and desirably set to more than 0°. When the angle θ' is set to more than 0°, as illustrated in FIG. 9A, the extended line of the slope surface of the regulating blade 102 and the extended line of the upstream surface of the V-groove in the rotation direction of the developing sleeve 103, which are extended toward the inside of the developing container (outwardly from the developing sleeve 103), intersect with each other (that is, have an intersection point). Meanwhile, when the angle θ' is set to 0° or less, those extended lines do not intersect with each other (that is, do not have an intersection point) as illustrated in FIG. 9B.

FIG. 9A shows the flow of the developer in the configuration in the embodiment. Little developer flowing toward the bottom surface of the groove recessed portion is subjected to shear. Meanwhile, as illustrated in FIG. 9B, when the angle θ' is 0° or more, the flow of the developer toward the bottom surface of the groove recessed portion occurs. The developer is subjected to slight shear in the groove recessed portion. As a result, the slight groove-clogging toner infrequently occurs even when the angle θ is set to less than 90°.

As described above, in the embodiment, in the case where the V-groove portions of the surface of the developing sleeve 103 is located in the closest position between the developing sleeve 103 and the regulating blade 102, the angle θ formed by the slope surface of the regulating blade 102 with the downstream surface of the V-groove in the rotation direction of the developing sleeve 103 is set to less than 90°. With this, the V-groove-clogging toner is reduced, and hence deterioration of the developer conveying properties and occurrence of an uneven pitch image due to a groove period are suppressed. As a result, an image forming apparatus performing stable image formation over a long period is achieved.

Second Embodiment

Next, another embodiment of the present invention will be described. Note that, a structure and operations of an image forming apparatus according to the embodiment are basically the same as those of the image forming apparatus according to the first embodiment. Thus, components having the same or equivalent functions and configurations are denoted by the same reference symbols, and not described in detail. The features of the second embodiment will be described below.

In the embodiment, a flat-plate-shaped regulating blade is used, and the flat-plate-shaped regulating blade is inclined with respect the developing sleeve. With this, as in the first embodiment, the angle θ formed the surface (inclined surface) of the regulating blade with the downstream surface of the V-groove in the rotation direction of the developing sleeve is set to less than 90°.

Figure 10:
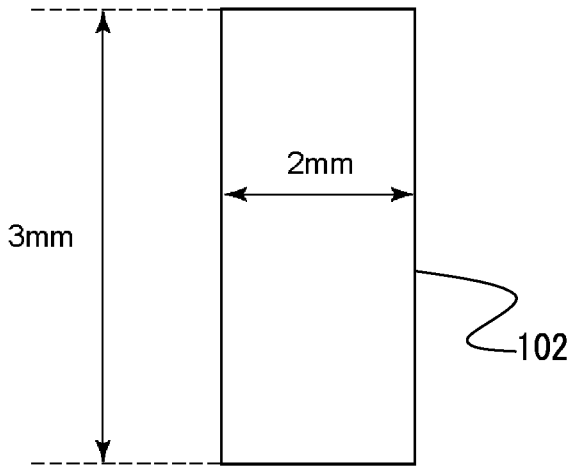
FIG. 10 is an explanatory view of a regulating blade according to a second embodiment of the present invention.
Figure 11:
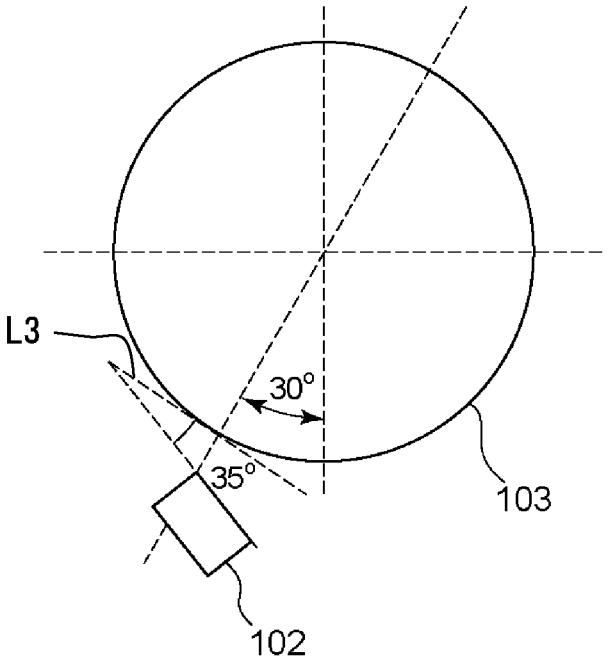
FIG. 11 is an explanatory view of an abutment position of the regulating blade according to the second embodiment of the present invention.

FIG. 10 illustrates the regulating blade 102 employed in the embodiment. FIG. 11 illustrates a positional relationship between the developing sleeve 103 and the regulating blade 102 in the embodiment. In the embodiment, the regulating blade 102 does not include the slope surface thereon. Instead, the regulating blade 102 is inclined at an angle of 35° with respect to a tangent L3 of the developing sleeve 103.

Figure 12:
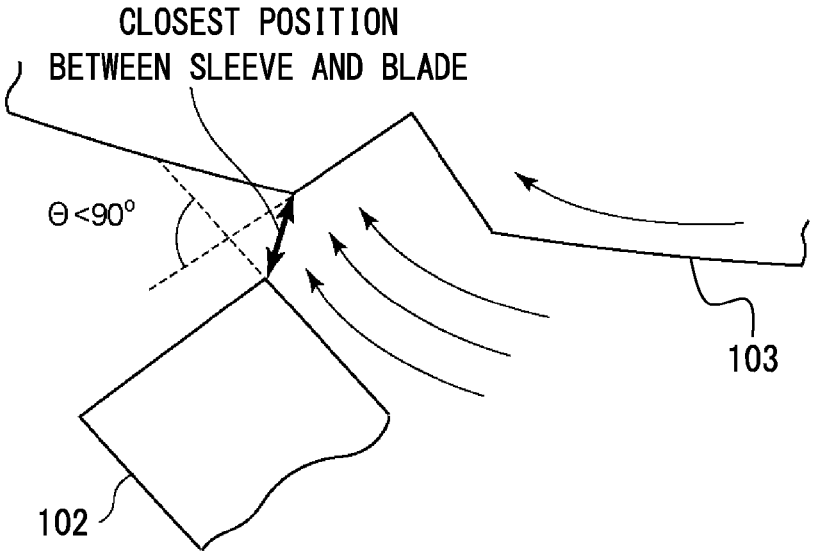
FIG. 12 is an explanatory view of illustrating movement of developer particles according to the second embodiment of the present invention.

Next, with reference to FIG. 12, movement of particles of the developer at an upstream position with respect to the regulating blade 102 in a case of using the regulating blade 102 and the developing sleeve 103 employed in the embodiment will be described. FIG. 12 is a schematic sectional view schematically illustrating a state of the two-component developer on the upstream side with respect to the position of the regulating blade 102. The developer drawn up to the surface of the developing sleeve 103 is carried on the surface of the developing sleeve 103, and conveyed to the vicinity of the position of the regulating blade 102 on the upstream side in the developer conveying direction. The developer conveyed to the vicinity on the upstream side of the regulating blade 102 is subjected to the layer thickness regulation at the position of the gap between the edge of the regulating blade 102 and the surface of the developing sleeve 103, and partially conveyed through the gap to the developing region.

As illustrated in FIG. 12, the angle θ formed by a surface of the regulating blade 102 with the downstream surface of the V-groove in the rotation direction of the developing sleeve 103 is set to less than 90°. With this, the flow of the developer toward the bottom surface of the groove recessed portion is suppressed, and the developer quickly flows out from the groove bottom surface. As a result, the groove-clogging toner is reduced.

As described above, in the embodiment, when the V-groove portions of the surface of the developing sleeve 103 is located in the closest position between the developing sleeve 103 and the regulating blade 102, the angle θ formed by the surface of the regulating blade 102 with the downstream surface of the V-groove in the rotation direction of the developing sleeve 103 is set to less than 90°. With this, the V-groove-clogging toner is reduced, and hence deterioration of the developer conveying properties and occurrence of an uneven pitch image due to a groove period are suppressed. As a result, an image forming apparatus performing stable image formation over a long period is achieved.

Third Embodiment

Next, still another embodiment of the present invention will be described. Note that, a structure and operations of an image forming apparatus according to the embodiment are basically the same as those of the image forming apparatus according to the first embodiment. Thus, components having the same or equivalent functions and configurations are denoted by the same reference symbols, and not described in detail. The features of the embodiment will be described below.

In the embodiment, in addition to the configuration according the first embodiment, a Teflon (trademark) coating is further performed on the downstream side of the groove slope surface. With this, frictional resistance on the downstream side of the groove slope surface is reduced so that the developer in the vicinity of the sleeve is more efficiently allowed to flow. In this way, the clogging toner in the groove recessed portion is reduced. In other words, the downstream side of the groove slope surface is set to be lower in surface roughness Rz than the upstream side of the groove slope surface.

Figure 13:
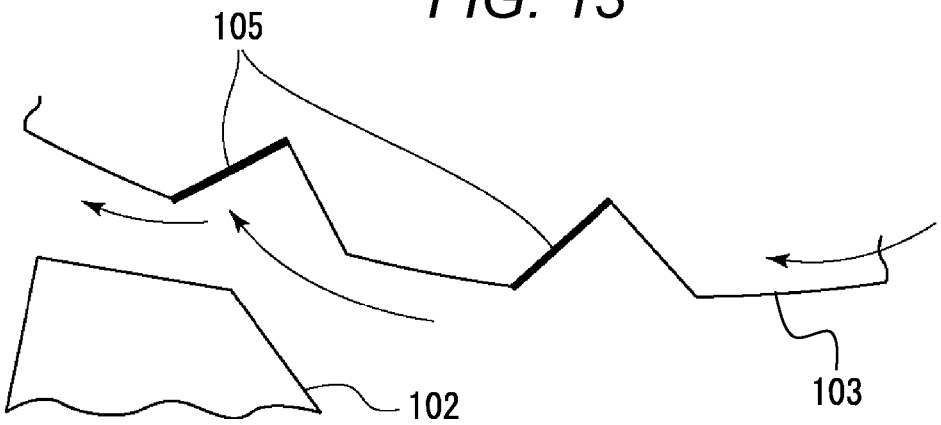
FIG. 13 is an explanatory view of a developing sleeve according to a third embodiment of the present invention.

FIG. 13 illustrates a developing sleeve 103 employed in the embodiment. A Teflon (trademark) coating 105 is formed on the downstream side of each of the groove slope surfaces of the developing sleeve 103 used in the embodiment. With this, the flow of the developer is promoted on the upstream side with respect to the closest position between the developing sleeve 103 and the regulating blade 102. As a result, an amount of coagulated toner left in the groove recessed portion is successfully reduced. Meanwhile, such a coating is not formed on the upstream side of the groove slope surface so as to secure developer conveying properties.

Note that, the same effect as that obtained by forming the Teflon (trademark) coating 105 on the downstream side of the groove slope surface in the embodiment can be obtained also by setting the surface roughness Rz to be lower on the downstream side of the groove slope surface. The same effect can be obtained also by forming, instead of the Teflon (trademark) coating, a ceramic coating or a nickel plating coating. Further, in a step of forming the V-groove, polishing may be performed so that the surface roughness Rz is smaller only on the downstream side of the groove slope surface.

Fourth Embodiment

Next, yet another embodiment of the present invention will be described. Note that, a structure and operations of an image forming apparatus according to the embodiment are basically the same as those of the image forming apparatus according to the first embodiment. Thus, components having the same or equivalent functions and configurations are denoted by the same reference symbols, and not described in detail. The features of the embodiment will be described below.

In the embodiment, in addition to the configuration according to the first embodiment, a Teflon (trademark) coating is further performed on the bottom surface of the groove recessed portion. With this, frictional resistance on the groove bottom surface is reduced, to thereby reduce the groove-clogging toner.

Figure 14:
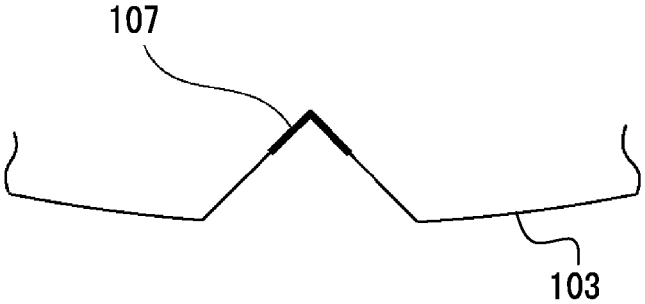
FIG. 14 is an explanatory view of a developing sleeve according to a fourth embodiment of the present invention.

FIG. 14 illustrates a developing sleeve 103 employed in the embodiment. A Teflon (trademark) coating 107 is formed on the groove bottom surface of the developing sleeve 103 used in the embodiment. With this, the amount of coagulated toner left on the groove bottom surface is successfully reduced. Meanwhile, such a coating is not formed except the groove bottom surface so as to secure developer conveying properties.

Note that, the same effect as that obtained by forming the Teflon (trademark) coating 107 on the groove bottom surface in the embodiment can be obtained also by setting the surface roughness Rz to be lower on the groove bottom surface. Further, the same effect can be obtained also by forming, instead of the Teflon (trademark) coating, a ceramic coating or a nickel plating coating. Further, in a step of forming the V-groove, polishing may be performed so that the surface roughness Rz is smaller only on the groove bottom surface.

Note that, although the developing apparatus exemplified in the description of the embodiments of the present invention uses the two-component developer including the non-magnetic toner and the magnetic carrier, the present invention is applicable to a developing apparatus employing a one-component developing process in which development is performed with a magnetic one-component toner or a non-magnetic one-component toner.

Further, although the groove exemplified in the description of the embodiments of the present invention has a V-shape, the present invention is not limited thereto. For example, the present invention is applicable to a trapezoidal groove.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-058903, filed Mar. 15, 2012, which is hereby incorporated by reference herein in its entirety.

What is claimed is:

1. A developing apparatus, comprising:

a developer carrying member configured to carry a developer to a developing region opposing an image bearing member, the developer carrying member having a surface provided with a plurality of grooves;

a regulating member configured to regulate an amount of the developer carried by the developer carrying member, wherein the regulating member includes a guide portion configured to guide the developer to a regulating position in which the regulating member is closest to the developer carrying member, the guide portion being located on an upstream side with respect to the regulating position in a rotation direction of the developer carrying member, the guide portion being shaped so that a gap between the guide portion and a tangent of the developer carrying member at the regulating position becomes narrower toward a downstream side in the rotation direction of the developer carrying member;

a downstream slope surface provided on the downstream side in the rotation direction of the developer carrying member within a region of each of the plurality of grooves, the downstream slope surface being sloped with respect to a normal direction of the developer carrying member, wherein, when a downstream end of the downstream slope surface and a downstream end of the guide portion of the regulating member are located in a closest position, the downstream slope surface and the guide portion of the regulating member form an angle θ less than 90°.

2. A developing apparatus according to claim 1, comprising an upstream slope surface provided within the region of each of the plurality of grooves, the upstream slope surface being sloped with respect to the normal direction of the developer carrying member on the upstream side in the rotation direction of the developer carrying member, and wherein an angle formed by the guide portion with the upstream slope surface is set so that, in the opposing portion, an extended line of the upstream slope surface and an extended line of the guide portion of the regulating member, which are extended outwardly from the developer carrying member, intersect with each other.

3. A developing apparatus according to claim 2, wherein the downstream slope surface of each of the plurality of grooves has a surface roughness lower than a surface roughness of the upstream slope surface.

4. A developing apparatus according to claim 1, wherein a surface roughness of a bottom surface of each of the plurality of grooves is lower than a surface roughness of other slope surfaces.

* * * * *